United States Patent [19]

Jochum

[11] 4,153,192

[45] May 8, 1979

[54] CONTROL MEMBER FOR FASTENING ELEMENT SETTING DEVICE

[75] Inventor: Peter Jochum, Meiningen, Fed. Rep. of Germany

[73] Assignee: Hilti Aktiengesellschaft, Schaan, Liechtenstein

[21] Appl. No.: 879,618

[22] Filed: Feb. 21, 1978

[30] Foreign Application Priority Data

Mar. 2, 1977 [DE] Fed. Rep. of Germany ..... 2709065

[51] Int. Cl.[2] ..... B25C 1/14

[52] U.S. Cl. ..... 227/10

[58] Field of Search ..... 227/9, 10

[56] References Cited

U.S. PATENT DOCUMENTS

| | | | |
|---|---|---|---|
| 2,801,416 | 8/1957 | Evans et al. | 227/10 |
| 3,204,400 | 9/1965 | Kvavle | 227/10 |
| 3,645,091 | 2/1972 | Ivanov | 227/10 |

FOREIGN PATENT DOCUMENTS

| | | | |
|---|---|---|---|
| 1232529 | 1/1967 | Fed. Rep. of Germany | 227/10 |
| 1251698 | 10/1967 | Fed. Rep. of Germany | 227/10 |
| 2447767 | 4/1976 | Fed. Rep. of Germany | 227/10 |
| 2254407 | 7/1975 | France | 227/10 |

*Primary Examiner*—Roy Lake
*Assistant Examiner*—John McQuade
*Attorney, Agent, or Firm*—Toren, McGeady and Stanger

[57] ABSTRACT

In an explosive powder operated setting device or gun for driving fastening elements, such as bolts, studs and the like, into a hard receiving material, the amount of explosive gases used in the driving operation is regulated by a control member located in the setting gun. The control member is conically shaped and fits into a conically shaped surface in the bore in the gun. The conical member is rotatably mounted in the bore between the firing chamber and an exhaust duct for regulating the amount of explosive gases diverted to the duct instead of being used in the fastening element driving operation.

15 Claims, 2 Drawing Figures

CONTROL MEMBER FOR FASTENING ELEMENT SETTING DEVICE

SUMMARY OF THE INVENTION

The present invention is directed an explosive powder operated setting device or gun for driving bolts, studs and the like into a hard receiving material, such as steel, concrete, and like materials, and the gun includes a barrel containing a firing chamber and one or more exhaust ducts connected through a bore in the barrel to the firing chamber. More particularly, the invention is directed to a control member arranged at the inlet to the exhaust duct for adjusting the opening to the duct for regulating the amount of explosive gases diverted from the firing chamber through the bore into the duct.

When fastening elements are driven into materials of varying hardness and strength, variable resistances have to be overcome. Accordingly, the driving power must be adjusted in accordance with existing conditions. In known setting devices operated by an explosive powder charge, the adjustment is achieved by varying the size of the explosive charge utilized. To avoid the cumbersome storage problem involved with the use of different explosive charge sizes, it has been known to employ a single explosive charge size and to utilize other means incorporated in the setting device for controlling the driving power.

In principle, the regulation of the driving power can be accomplished in two ways. One way involves the so-called adjustment of the dead space in the position rearwardly of the driving piston where the initial volume of the firing chamber is varied. In addition to this type of control which involves the use of complicated parts susceptible to trouble and fouling, it has also been known to divert a portion of the explosive gases unused into the atmosphere.

In one known setting gun, its barrel is provided, at a rearward location, with exhaust ducts. The explosive charge is positioned in a sleeve and supported in the barrel so that it can be rotated. Moreover, the sleeve contains outlet openings which can be placed in varying degrees of communication with the exhaust duct. Due to the play required for rotating the sleeve, a sealing gap is formed between the outer surface of the sleeve and the bore in the barrel. Unburned particles of the explosive charge can penetrate and collect in the sealing gap and cause jamming of the sleeve. If an after-burning of these combustible particles takes place subsequently, the sleeve, due to the pressure developed in the after-burning, is radially compressed and the amount of play between the sleeve and the bore increases. As a result, after a short period of time the sleeve becomes damaged and must be replaced.

Therefore, the primary object of the present invention concerns a control member for an explosive powder operated setting device which facilitates optimum sealing and affords a long working life.

In accordance with the present invention, the control member includes a sealing cone with its conical surface converging in the direction in which force is applied from the action of the explosive gases generated in the firing chamber, and the bore in the barrel has a complementary conically shaped surface into which the sealing cone seats. In such an arrangement, radial play is eliminated between the cooperating surfaces. When an explosive powder charge is fired, the explosive gases press the sealing cone tightly against the conically shaped seating surface in the bore. Accordingly, since there is no play between the complementary surfaces, unwanted power losses cannot occur.

For an optimum sealing effect, it is advantageous if the inlet openings to the exhaust duct or ducts are located in the conically shaped seating surface formed in the bore, that is the surface which provides a seat for the sealing cone. With such an arrangement, sealing gaps are avoided. Moreover, this arrangement results in a compact setting device.

To make the sealing surfaces as small as possible and, thereby, reduce the danger of fouling, it is advantageous if the sealing cone on the control member is positioned on the end of the control member against which the explosive gases act. With such a construction, the mobility of the control member is ensured, since any residues from the firing action cannot enter into the passageway through which the control member extends. For providing simplified control of the driving power, it is advantageous to afford explosive gas outlet openings in the control member having variable cross-sections so that by rotating the control member different outlet openings can be placed in register with the inlet to the exhaust duct. The cross-section of the different discharge openings can be graduated to provide a step-by-step control of the driving power. A notch indicating each position facilitates operation of the control member.

To afford optimum adjustment of the driving power based on existing conditions, it is advantageous if the control member is constructed with a frusto-conical surface of varying length in the region of the inlet to the exhaust duct. By rotating the frusto-conical surface an infinite adjustment of the driving power is attainable. By properly shaping the frusto-conical surface a very fine adjustment of the driving power is possible.

The various features of novelty which characterize the invention are pointed out with particularity in the claims annexed to and forming a part of this disclosure. For a better understanding of the invention, its operating advangages and specific objects attained by its use, reference should be had to the accompanying drawings and descriptive matter in which there are illustrated and described preferred embodiments of the invention.

DETAILED DESCRIPTION OF THE INVENTION

Figures 1, 2:
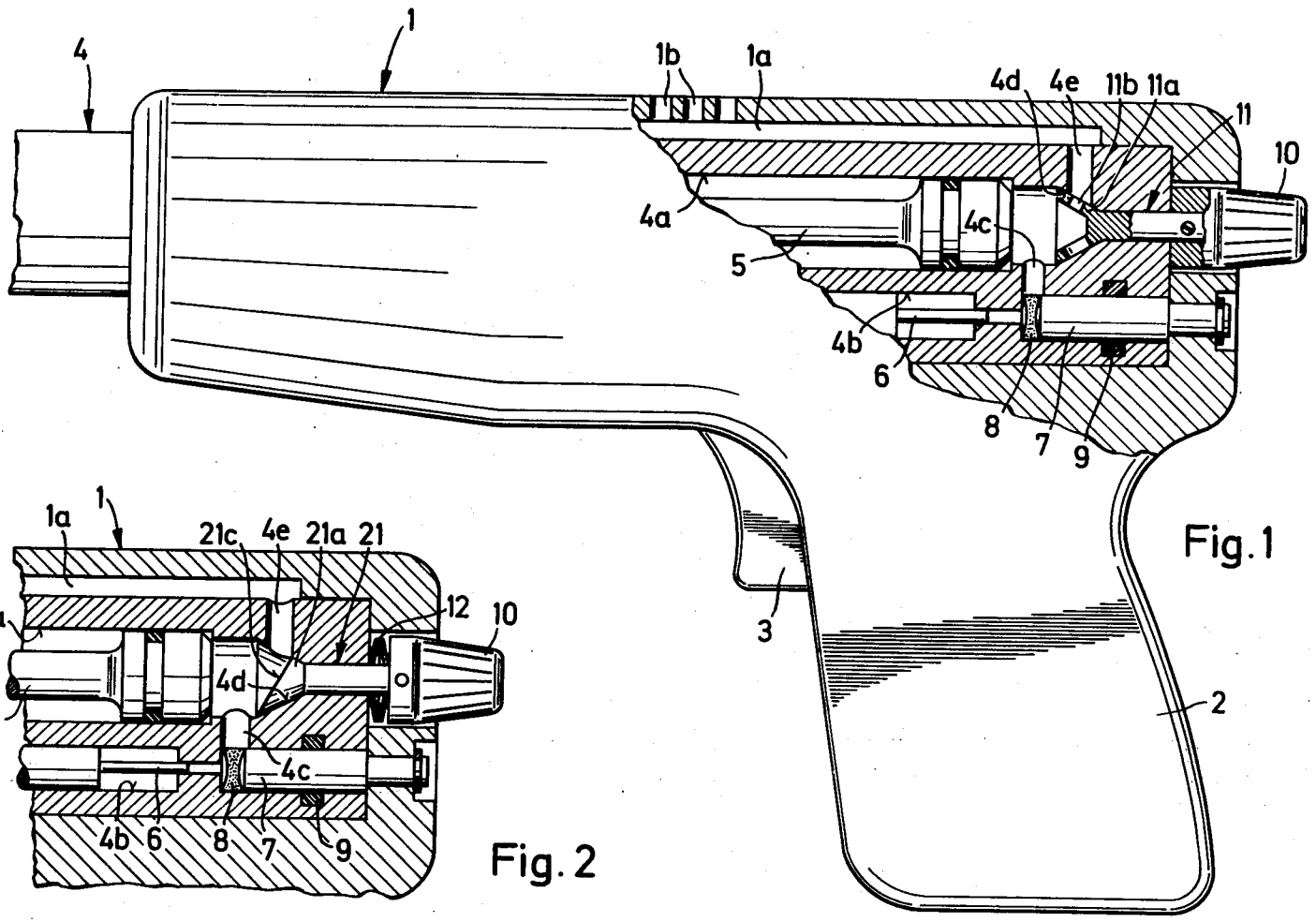
FIG. 1 is a side view, partly in section, of a setting device embodying the present invention.
FIG. 2 is a partial sectional view of another setting device also embodying the present invention.

In FIG. 1 an explosive powder operated setting device or gun is illustrated and includes a housing 1 with a grip handle 2 extending downwardly from a rearward end of the housing. A trigger 3 is located in the handle 2. A barrel 4 extends, in the firing direction of the device, from the housing 1, that is in the leftward direction as shown in FIG. 1. The barrel 4 is axially movably supported within the housing 1. When the forward end of the barrel is pressed against a receiving material, it is moved axially rearwardly into the position illustrated in FIG. 1. An axially extending bore **4*a* is located in the barrel and a driving piston 5 is axially movable supported in the bore. Below the bore 4*a*, in a passageway 4*b*, an ignition pin 6 extends in parallel relation with the bore in the barrel. Aligned rearwardly of the ignition pin is a counterpin 7 stationarily secured in the housing 1, note the counterpin extends rearwardly from the end of the barrel into the rearward end of the housing. When the barrel is pressed against the receiving material and moves rearwardly, the barrel slides over the counterpin 7 and an explosive powder charge 8 is displaced out of a magazine 9 and into the firing chamber located immediately forwardly of the counterpin, in the position shown in FIG. 1 and rearwardly of the ignition pin. When a charge 8 is fired, the explosive gases generated flow through a connecting duct 4c into the rearward end of the bore 4a and act on the rearward end of the driving piston 5 for propelling it forwardly against a fastening element. Spaced rearwardly of the point at which explosive gases are introduced into the bore 4a from the connecting duct 4c, is a control member 11 which extends from the rearward end of the bore through the adjacent end of the barrel and the end of the housing. The control member 11 includes a rotary knob 10 which extends rearwardly from the housing so that it is accessible on the exterior of the setting gun. By manipulating the knob 10, the control member can be rotated about an axis parallel to or coaxial with the axis of the bore. Within the rearward end of the bore 4a, the control member includes a frusto-conical part 11a which is cup-shaped having its opening facing in the driving direction of the setting device. Explosive gases flowing into the bore act on the surface of the frusto-conical part facing in the firing direction. The explosive gases press the frusto-conical part and, therefore, the control member, against a complementary seating surface 4d formed in the barrel 4 at the rearward end of the bore 4a. As can be seen in FIG. 1, the contacting surfaces of the frusto-conical part 11a and of the seating surface 4d are in sealing contact. In the range of the seating surface 4d, the barrel 4 has at least one exhaust duct 4e extending generally outwardly from the bore 4a, with the inner or inlet end of the duct located in the seating surface 4d. About the outer surface of the barrel 4 is an axially extending compensating chamber 1a to which the outer or outlet end of the exhaust duct 4e extends. Extending through the frusto-conical part 11a are a plurality of variably sized openings 11b affording different sized openings from the rearward end of the bore 4a through the part 11a into the exhaust duct 4e. By rotating the knob 10 on the outside of the setting device, the frusto-conical part 11a can be displaced on sliding contact with the seating surface 4d for aligning a particular opening with the inlet end of the exhaust duct 4e. Accordingly, to control the driving power transmitted through the driving piston, a portion of the explosive gases can be diverted through one of the openings 11b into the exhaust duct 4e for flow into the compensating chamber 1a and then into the atmosphere through the exhaust bores 1b in the housing forwardly of the connection between the exhaust duct and the compensating chamber. As a result, the driving power of the setting gun is regulated by the control member which permits selective positioning of the openings 11b in register with the exhaust duct 4e**.

In FIG. 2 another embodiment of the invention is illustrated in which similar reference numerals are used for the same parts employed in FIGS. 1 and 2. In this embodiment, however, another control member 21 is displayed for regulating flow of explosive gases into the exhaust duct 4e. The end of the control member 21 located within the rearward end of the bore 4a consists of a frusto-conical part 21a. The part 21a can be rotated via the rotary knob 10 which extends rearwardly from the end of the setting gun housing 1. The function of the control member and its frusto-conical part 21a are the same as for the embodiment in FIG. 1, however, instead of the openings 11b provided through the part 11a, the frusto-conical part 21a terminates at its end facing in the firing direction in a control surface 21c. The control surface extends transversely of the conical axis of the part 21a and is located at an oblique angle to the conical axis. By rotating the control member, the frusto-conical part 21a is rotated varying the position of the end surface 21c relative to the inlet to the exhaust duct 4e. As can be seen in FIG. 2, the inlet to the exhaust duct 4e is fully open. By rotating the part 21a, the position of the end surface 21c relative to the inlet to the exhaust duct is varied providing an infinite adjustment of the inlet between the fully opened and fully closed positions. To eliminate any axial play between the control member part 21a and its complementary seating surface 4d in the end of the bore prior to the firing of an explosive charge, a pair of cup springs 12 laterally enclose the control member at the point where it extends rearwardly outwardly from the end of the barrel 4 and the springs also bear against the forward face of the rotary knob 10. These springs provide a force acting on the control member in the same direction as the force provided by the explosive gases.

While specific embodiments of the invention have been shown and described in detail to illustrate the application of the inventive principles, it will be understood that the invention may be embodied otherwise without departing from such principles.

I claim:

1. An explosive powder operated setting device for driving fastening elements such as bolts, studs and the like, into a hard receiving material, comprising a barrel having an axially extending bore from which a fastening element can be driven into the receiving material, a firing chamber located within said barrel and arranged for supplying explosive gases into the bore, at least one exhaust duct in said barrel and arranged to receive explosive gases from said bore for diverting the gases from use in setting a fastening element, a movably positionable control member located in said barrel and in the path of flow of the explosive gases between said firing chamber and said exhaust duct for regulating the flow of explosive gases to said exhaust duct, wherein the improvement comprises that said control member comprises a conical member with the conical surface thereof converging in the direction in which the force of the explosive gases is applied to said control member, and said bore forming a conical seating surface having a complementary shape to the shape of the conical surface of said conical member with the conical surface of said conical member seated in contacting engagement with said seating surface, and said conical member arranged to be displaced in sliding contact with said seating surface for selectively varying the flow of explosive gases to said exhaust duct.

2. An explosive powder operated setting device, as set forth in claim 1, wherein said exhaust duct has an inlet end located in said seating surface for receiving explosive gases from said firing chamber.

3. An explosive powder operated setting device, as set forth in claim 2, wherein said conical member has a plurality of angularly spaced openings therethrough each arranged for separate alignment with the inlet end of said exhaust duct in said seating surface for varying the amount of explosive gases diverted from the bore into said exhaust duct.

4. An explosive powder operated setting device, as set forth in claim 2, wherein said conical member is rotatable about its cone axis in sliding engagement with said seating surface and has an end surface extending across and disposed at an oblique angle to the cone axis for varying the opening in said seating surface to said exhaust duct as said conical member is rotated.

5. An explosive powder operated setting device, as set forth in claim 1, including spring means for biasing said conical member into contacting engagement with said seating surface.

6. An explosive powder operated setting device for driving fastening elements, such as bolts, studs and the like into a hard receiving material, comprising a housing, a barrel having an axially extending bore therein, said barrel being displaceably mounted in said housing in the axial direction of said bore, a firing chamber located in said barrel and disposed in communication with said bore, at least one exhaust duct in said barrel and connected at one end thereof to said bore and arranged to divert explosive gases from use in the setting of fastening elements and to exhaust the gases from the setting device, a control member movably positionably mounted in said barrel and extending into said bore into the path of flow of the explosive gases between said firing chamber and said exhaust duct for regulating the flow of said explosive gases diverted into said exhaust duct, wherein the improvement comprises that said bore has a rearward end at the opposite end of said barrel from which fastening elements are propelled into the receiving material, the rearward end of said bore has a frusto-conically shaped seating surface extending around an axis at least parallel with the axis of said bore, said exhaust duct has a first end located in said seating surface and said exhaust duct extends outwardly from said seating surface transversely of the axial direction of said bore, said control member extending through said barrel in the axial direction of said bore into the rearward end of said bore and said control member including a frusto-conical member having the frusto-conical surface thereof complementary to said seating surface and disposed in sliding sealing engagement therewith, said frusto-conical member being rotatable about its conical axis and being arranged to vary flow into said exhaust duct as it is rotated about its conical axis in sliding sealing contact with said seating surface.

7. An explosive powder operated setting device, as set forth in claim 6, wherein said frusto-conical member has the frusto-conical surface thereof converging toward the rearward end of said bore.

8. An explosive powder operated setting device, as set forth in claim 7, wherein said frusto-conical member has a plurality of angularly spaced openings extending through the frusto-conical surface thereof for providing communication from said bore to said exhaust duct and the openings being of varying diameters and each said opening arranged to align with the first end of said exhaust duct for admitting a different amount of explosive gases to said exhaust duct than supplied by the other said openings.

9. An explosive powder operated setting device, as set forth in claim 8, wherein said frusto-conical member is cup shaped with the opening provided by its cup shape facing in the opposite direction from the rearward end of said bore, and the openings through the frusto-conical surface of said frusto-conical member opening into the interior of the cup shape member.

10. An explosive powder operated setting device, as set forth in claim 9, wherein said control member includes a knob projecting from the rearward end of said barrel in the axial direction of said bore and projecting outwardly from said housing for rotating said control member and said frusto-conical member thereon.

11. An explosive powder operated setting device, as set forth in claim 6, wherein said firing chamber is located radially outwardly from and opens into said bore forwardly of said frusto-conical seating surface, and said exhaust duct located on the opposite side of said bore from said firing chamber.

12. An explosive powder charge operated setting device, as set forth in claim 11, including means in said barrel for loading explosive powder charges into said firing chamber.

13. An explosive powder operated setting device, as set forth in claim 6, wherein said frusto-conical member has an end surface facing in the opposite direction from the rearward end of said bore, said end surface extending transversely of one end of the frusto-conical surface of said frusto-conical member and extending at an oblique angle to the conical axis of said frusto-conical member so that as said frusto-conical member rotates about its conical axis the frusto-conical surface thereof affords a varying closure of the first end of said exhaust duct.

14. An explosive powder operated setting device, as set forth in claim 13, wherein said firing chamber is located forwardly of said seating surface in said bore and said exhaust duct extends radially outwardly from said seating surface on the opposite side of said bore from said firing chamber.

15. An explosive powder operated setting device, as set forth in claim 13, wherein said control member extends out of the rearward end of said barrel in alignment with the bore therein, a knob on the end of said control member projecting from said barrel and being accessible on the exterior of said housing, and spring means positioned between said knob and said barrel and biasing said frusto-conical member into sealing contact with said seating surface.

* * * * *